United States Patent [19]

Vijayendran

[11] 3,965,023

[45] June 22, 1976

[54] METHOD OF PRODUCING LIQUID TONERS CONTAINING FURNACE BLACK FOR DEVELOPING ELECTROSTATIC IMAGES

[75] Inventor: Bheema Rao Vijayendran, Bethel, Conn.

[73] Assignee: Pitney-Bowes, Inc., Stamford, Conn.

[22] Filed: Sept. 24, 1974

[21] Appl. No.: 508,819

[52] U.S. Cl. ..... 252/62.1 L; 260/37 R
[51] Int. Cl.[2] ..... G03G 9/12
[58] Field of Search ..... 252/62.1 L; 260/37 R

[56] References Cited

UNITED STATES PATENTS

| | | | |
|---|---|---|---|
| 3,391,015 | 7/1968 | Fauser | 252/62.1 L |
| 3,507,794 | 4/1970 | Fauser | 252/62.1 L |
| 3,542,682 | 11/1970 | Mutaffis | 252/62.1 L |
| 3,826,747 | 7/1974 | Nagashima et al. | 252/62.1 L |
| 3,841,893 | 10/1974 | Honjo et al. | 252/62.1 L |

*Primary Examiner*—Mayer Weinblatt
*Assistant Examiner*—John D. Smith
*Attorney, Agent, or Firm*—William D. Soltow, Jr.; Albert W. Scribner; Peter Vrahotes

[57] ABSTRACT

A method is disclosed for the making of a liquid toner having large size pigment particles which are created through flocculation of fine size pigment. The toner is especially useful in copying machines that use a development electrode.

16 Claims, No Drawings

METHOD OF PRODUCING LIQUID TONERS CONTAINING FURNACE BLACK FOR DEVELOPING ELECTROSTATIC IMAGES

BACKGROUND OF THE INVENTION

In electrophotographic copying machines involving image development with colloidal dispersions of pigment in a low conductivity liquid carrier, one is likely to obtain copies which are deficient in quality at reasonable machine speeds if the original to be copied contains printed areas which are of the order of about 3/16 inch or greater in width unless a so-called "development electrode" is employed. The development electrode is usually a metallic conductive device, sometimes grounded, other times "floating" electrically, and sometimes biased with an appropriate potential, placed near or in contact with a photoconductor surface bearing a charged image during the development step. The development electrode serves to improve the ability of the developer or "toner" to fill in the interior parts of wider regions of the copy by locally modifying the strength of the electrostatic field of the image area as the field extends into the toner. In the absence of an electrode, the field strength is greatest at the edges of an electrostatic image and falls off rapidly toward the interior of the image. The strength of the field determines how many oppositely charged toner pigment particles will migrate to the charged image; therefore, the image becomes developed to a high density at the edge and to a lower density at the center. In the case of extremely large black areas on an original, a relatively low density print develops at the center of the image on the copy while a relatively high density print develops at the edge of the same image on the copy. This results in a copy which gives a poor appearance. When a development electrode is employed, the field strength is modified by it so that the strength becomes more nearly uniform across a large image area. The developed image of the large area also becomes more uniform in density and results in a copy with an improved appearance.

In "conventional" liquid toners, many of the colloidal pigment particles are present as either flocculates or as agglomerates. Flocculates are clumps of particles which are dispersed at some point in time but which, either because of insufficient like particle charge or because of opposite particle charge, have since come together and grown in size. Agglomerates, in contrast to flocculates, are groups of particles which were never completely dispersed in the toner carrier liquid.

When a conventional liquid toner is employed in conjunction with a development electrode, and particularly with an electrode which contacts the photoconductor surface, there is observed a drop in image density of fine line copy and an increase in the "background" or non-image density. It is believed that this occurs because the high field strength causes rapid motion of the charged toner particles in the liquid. Since many of the toner particles are loosely-held-together flocculates or agglomerates, they break apart, some of their fragments having considerably reduced charge and possibly even charge of opposite sign to the bulk of the particles in the toner. Increased background density can result from a localized greater number concentration of particles of smaller size resulting from the breakup of flocculates or agglomerates and/or from the sudden localized presence of oppositely charged fractions in the toner. It obviously would be beneficial to be able to utilize a development electrode without the attending increased background difficulty.

SUMMARY OF THE INVENTION

It has been found that the high background density problem associated with use of a development electrode may be eliminated through use of a toner having high strength flocculated pigment with a particle size of 0.5 to 2.5 microns. Agglomerated pigments are not reliable since the cohesive strength is uncontrollable.

Large particle, high strength flocculated pigments are prepared for a liquid toner wherein the particle size of the pigment varies from 0.5 to 2.5 microns. This is accomplished by initially mildly blending a carbon black, a polymer and liquid hydrocarbon for a period of several hours or strongly blending for a period of a few minutes. Subsequently, the milled ingredients are stored and the flocculates are allowed to settle. The sediment is then collected and added to a large quantity of liquid hydrocarbon and a charge director in order to produce a liquid toner which preferably will comprise 1–10 parts sediment and 90 to 99 parts liquid hydrocarbon. Although this method for producing a liquid toner results in a toner of general use which reduces background density, it has been found particularly adaptable with copiers utilizing a development electrode.

DESCRIPTION OF THE PREFERRED EMBODIMENT

A method of preparation of toners has been found for electrophotography which produce dense copy of an original for use in a copier with and without a development electrode. The toner prepared through this method yields a copy having uniform image density without increase of background density as the method results in large particle "toners" which are present as high strength flocculates.

Large particle toners in the development of electrostatic image offer several advantages such as high contrast, fill in of large image areas, good stability, etc. Toner particles in conventional liquid toners, based on carbon black, are mostly in the submicron particle range. In the instant method of making large particle toners from carbon black a flocculating technique is employed which results in particles having a size of 0.5 to 2.5 microns.

Primary particles of carbon black are usually in the range of 10 – 100 m$\mu$ (electron microscope) depending on the type of carbon black; however, carbon black particles are usually in clusters and are rarely seen individually. This clustering or aggregating exhibit of carbon black is usually attributed to physical as well as to chemical bonding effects. There are five basic types of carbon blacks - lamp black, channel, thermal, acetylene and furnace and they all exhibit clustering to some degree or other. These units are quite irregular in shape and exhibit a substantial length, i.e. 0.5 to a few microns, in some of the large aggregated carbon blacks. Under normally used dispersion conditions, such as sand milling, attritor milling, ball milling, etc., it appears that these long fibrous units are often subject to fracture; however, it is unlikely that the aggregates of any carbon black with the possible exception of the thermal types can ever be broken down into the individual particle units. As a result, the toner particles in prior art liquid toners based on carbon black are dispersed to submicron range rather than the millimicron range of the individual particles.

In accordance with this invention, large particle toners are made by using carbon black of certain size in combination with unique processing conditions to produce "flocs" of toner particles which are strongly bonded and have an overall size of 0.5 to 2.5 microns. We achieve this by choosing the furnace type of carbon black which has preferably a primary particle size of 15–100 mμ. Furnace black is preferred over channel black even though it has comparable size range because the furnace black has a greater tendency to cluster than the channel blacks. Thermal (150–500 mμ) and lamp black (50–100 mμ) type carbon blacks are too large and the surfaces are not active enough to absorb the polymers and charge directors. Acetylene black (35–50 mμ) seems to have the same particle range as furnace black but its oil absorption is too high which creates problems in dispersion of the pigment. Hence, we find that the best candidate in terms of particle size and structure are the furnace blacks having a particle range of 15–100 mμ.

Typical examples of commercially available furnace black are Mogul-L, Regal 400R, Regal 99R, and Elflex 8, all available from Cabot Corp., Boston, Mass. and Raven 50, Raven 150, Raven 1200, Pearlers, and Raven 30, all available from Columbian Carbon Co., N.Y. In this approach, a mild type of dispersion, e.g. ball milling and pebble milling, is used for a substantial period of time, for example 24 to 36 hours, so that the broken down carbon black particles are fairly strongly flocked into units having a size of 0.5–2.5 micron. Included in the ball mill charge is 2–10% carbon black 40–60% polymer and 40–70% liquid hydrocarbon. A charge director is not added in the milling step so as to facilitate the fracture of carbon aggregates. The mill ingredients are then stored, i.e. laid aside and allowed to settle. After settling, the carbon black sediment is removed.

Alternatively using more powerful dispersion equipment for strong milling, such as a sand mill or attritor milling, the carbon black pigment is dispersed in the hydrocarbon vehicle with a polymer first without any addition of charge directors. Using strong milling equipment requires milling time of only a few minutes. The dispersed pigment compound is allowed to settle down after distribution with the large particles settling and the fine particles remaining in suspension; and the settled particles, which are aggregates of 0.5–2.5 microns, are used to make toners by adding the pigments with an appropriate polymer to a liquid hydrocarbon and, optionally, a charge director to form a concentrate. The concentrate should comprise 2–15% pigment, 10–50% polymer and 40–80% hydrocarbon. Optionally up to 8% dye may be added to tint the image. Dyes used for this purpose are well known in the art.

The carrier liquid should be an aliphatic saturated hydrocarbon fluid, it being well known that this particular class of carriers is preferred by virtue of the following characteristics: (a) quick evaporation, e.g., a thin film of the carrier will evaporate in a few seconds at a temperature below the char point of paper, so as to permit fast drying; (b) non-toxity; (c) low odor; (d) sufficient fluidity to allow dispersed particles to migrate therethrough with ease so that they are capable of being quickly electrostatically attracted to and coupled with the pattern of electrostatic charges which is to be developed; (e) lack of adherence to the binder or other ingredients of the photoconductor coating (f) non bleeding to the electrostatic charges before the particle is deposited so as to maintain any desired degree of contrast; and (g) inexpensiveness.

In order to obtain these beneficial characteristics, the petroleum fraction, as for example, paraffinic solvent and isoparaffinic solvent should have an evaporation rate at least as fast as that of kerosene, but slower than that of hexane. Thereby, the evaporation of the liquid from a film will be rapid, e.g., two seconds, or less, at a temperature immediately below the char point of paper, it being customary to raise the temperature of the film of liquid developer to this level for the purpose of evaporating the developer after the electroscopic particles of the toner have been deposited by attraction on the electrostatically charged pattern. The aliphatic saturated hydrocarbon should have a low K.B. (Kauributanol) number, to wit, less than 35, and preferably between 25 and 35. This low K.B. number minimizes the possibility that the petroleum fraction will attack the coating binder, e.g., the binder for a zinc oxide photoconductor. The aliphatic saturated hydrocarbon also should be substantially free of aromatic liquid constituents. This term as used herein, connotes that the proportion of aromatic liquids in the organic liquid carrier should not be in excess of approximately two percent by weight. The aromatic liquids have a strong tendency to attack the coating binders, e.g., the coating binders for zinc oxide, but in concentrations of less than two percent this tendency is so negligible as to be unnoticeable. The petroleum fraction must have a high electrical resistivity, e.g., in the order of at least $10^9$ ohm centimeters, and a dielectric constant of less than 3.5 so that the liquid carrier will not dissipate the pattern of electrostatic charges which are to be developed. The TTC (Tagliabue closed cup) flash point of the liquid carrier should be at least 100°F (38°C) whereby under the conditions of use the liquid is considered non-flammable.

The solvent also should be non-toxic possess no objectionable odor and preferably is odor-free, this being denoted by the term "low odor".

Consonant with its low dielectric constant and high resistivity, the liquid carrier should be non-polar. The petroleum fractions preferably have two other advantages, low viscosity and inexpensiveness.

Examples of petroleum fraction organic liquid carriers having physical characteristics which fall within the foregoing criteria are paraffinic or isoparaffinic hydrocarbons such as Isopar G manufactured by Exxon Corporation and Soltrol 100 manufactured by Phillips Petroleum.

The polymeric material must be soluble in the saturated low K.B. solvent isoparaffinic hydrocarbon fluid and is preferably an acrylic polymer, an olefin-alkylated polyvinylpyrrolidone or a beta-piene having a high degree of affinity for adsorption on the pigment. Examples of such polymeric materials are Neocryl B-707, manufactured by Polyvinyl Chemicals, Inc., Ganex 216, manufactured by GAF Corp.; and Gammaprene A-115 manufactured by Reichhold Chemicals, respectively. Throughout this specification, including the appended claims, the term polymer is used to specify a polymeric material soluble in a low K.B. solvent.

Various charge director compounds may be added, in accordance with the invention after flocculation, if desired, to the toner compositions. The charge directors, which are per se well known in the field of electrostatic liquid toners, must be soluble or dispersible in the aliphatic saturated hydrocarbon and must create or augment an electrostatic charge on the dispersed particles. Examples of usable charge directors pursuant to this invention are aluminum stearate; cobalt salt of 2-ethyl hexanoic acid; iron salt of 2-ethyl hexanoic acid; manganese salt of 2-ethyl hexanoic acid; zirconium salt of 2-ethyl hexanoic acid; manganese linoleate; metal salts consisting of naphthenic acid and metals such as manganese, cobalt, nickel, zinc, chromium, magnesium, lead, iron zirconium, calcium and aluminum. Negative charge directors, for reversal toners, would include compounds of: phospholipids, lecithin, and sulfonates.

The desirable amount of such a charge director dissolved in the carrier liquid consisting of said hydrocarbon is in the range of from 0.01 gm to 1 gm per 1000 gm of the liquid carrier.

EXAMPLE I

The following ingredients were placed in a sand mill:

| | |
|---|---|
| Regal 400 R (Cabot Corp.) | 12 grams |
| Alkali Blue R (Sherwin Williams) | 1 gram |
| Necroyl B 707 (Polyvinyl Industries) | 160 grams |
| Isopar G (Exxon Chemical Corp.) | 210 grams |

The above ingredients were strong milled in the sand mill for 15 minutes. Ten grams of the dispersed concentrate was mixed with 100 grams of Isopar G and allowed to settle for 24 hours. The sediment, which basically consisted of flocculates of one to two microns, were removed and used to make an intensifier. The intensifier was made as follows: about five grams of the sediment was mixed with 133 grams of Isopar G containing two grams of zirconium octoate. A toner was prepared by diluting the intensifier 1:9 with Isopar G. The toner produced good copies having good fill-in, edge definition, and low background. The toner particle appeared to be aggregates 1–2 microns consisting of strongly bond flocculates.

EXAMPLE II

Another toner was prepared in a method similar to Example I. The following ingredients were placed in a Szegvari type attritor mill:

| | |
|---|---|
| Raven 1200 (Columbian Carbon Co.) | 12 grams |
| Alkali Blue R (Sherwin Williams Co.) | 1 gram |
| Neocryl B-707 polymer (Polyvinyl Cehnical Corp.) | 160 grams |
| Isopar G (Exxon Chemical Corp.) | |

The above ingredients were strong milled in the Szegvari attritor mill for 20 minutes. The same procedure as Example I were followed and a similar toner was produced giving equally good results.

EXAMPLE III

A milder type of dispersion of the carbon black pigment was achieved by ball milling as follows:

| | |
|---|---|
| Mogul-L Carbon Black (Cabot Corp.) | 22 parts |
| Alkali Blue - G (Allied Chemicals) | 6 parts |
| Ganex V-220 20% solids Ganex-V220 Resin in Solvent (GAF Corp.) | 50 parts |

-continued

| | |
|---|---|
| Soltrol-100 (Phillips Petroleum) | 22 parts |

The above ingredients are ball milled 24 to 36 hours using a ratio of charge to grinding media (½ inch cylinder Burundun media) of 1:2.5. After the ball milling the dispersion was allowed to settle out for 2 days. The sedimented portion consisting of strongly bonded flocs was used in the subsequent steps.

To 10.3 parts of the sediment were added five parts of zirconium octoate, 5.6 parts AC-432 resin (Allied Chemicals) and 79 parts Soltrol-100 solvent. This was stirred for 15–30 minutes to produce an intensifier. To twenty parts of intensifier were added 80 parts of stabilized Soltrol-100 to prepare the working toner. The working toner under microscopic examination was found to consist of strongly bonded flocs of 0.5–2.5 micron particles. The toner produced copies having good fill-in, good edge definition and low background.

What is claimed is:

1. In a method of producing a liquid toner, the steps comprising:

A. charging into a mill a furnace black having a particle size ranging from 15–100 milimicrons, a polymer which is soluble in a liquid hydrocarbon, and a first non-polar liquid hydrocarbon having a K.B. number between 25 and 35, an electrical resistivity of at least $10^9$ ohm-cm and a dielectric constant of less than 3.5;

B. mildly milling said ingredients for a period of 24–36 hours;

C. storing the milled ingredients to allow such ingredients to settle, thereby forming a sediment;

D. separating the sediment which has settled during storage; and

E. mixing the sediment from the milled ingredients with a liquid hydrocarbon having said properties of said first liquid hydrocarbon.

2. The method of claim 1 including adding a charge director to the liquid hydrocarbon and sediment mixture.

3. The method of claim 1 wherein said milling of the ingredients is ball milling.

4. The method of claim 1 wherein said milling of the ingredients is pebble milling.

5. In a method of producing a liquid toner, the steps comprising:

A. charging into a mill a furnace black having a particle size ranging from 15–100 milimicrons, a polymer which is soluble in a liquid hydrocarbon, and a first non-polar liquid hydrocarbon having a K.B. number between 25 and 35, and electrical resistivity of at least $10^9$ ohm-cm and a dielectric constant of less than 3.5;

B. strongly milling said ingredients for a period of 15–20 minutes;

C. storing the milled ingredients to allow such ingredients to settle, thereby forming a sediment; and D. separating the sediment which has settled during storage; and E. mixing the sediment from the milled ingredients with a liquid hydrocarbon having said properties of said first liquid hydrocarbon.

6. The method of claim 5 including adding a charge director to the liquid hydrocarbon and sediment mixture.

7. The method of claim 5 wherein said milling of the ingredients is by attritor milling.

8. The method of claim 5 wherein said milling of the ingredients is by sand milling.

9. In a method of producing a liquid toner, the steps comprising:

A. charging a mill with 10–30% furnace black, having a particle size ranging from 15–100 millimicrons, 10–50% polymer which is soluble in a liquid hydrocarbon and a 40–70% liquid hydrocarbon having a K.B. number between 25 and 35, an electrical resistivity of at least $10^9$ ohm-cm and a dielectric constant of less than 3.5;

B. strongly milling said ingredients for a period of 15–20 minutes;

C. storing the milled ingredients to allow such ingredients to settle, thereby forming a sediment;

D. seperating the sediment which has settled during the storage; and

E. mixing one to ten parts of the sediment from the milled ingredients with 90 to 99 parts of a liquid hydrocarbon.

10. The method of claim 9 including adding a charge director to the liquid hydrocarbon and sediment mixture.

11. The method of claim 9 wherein said milling of the ingredients is by attritor milling.

12. The method of claim 9 wherein said milling of the ingredients is by sand milling.

13. In a method of producing a liquid toner, the steps comprising:

A. charging a mill with 10–30% furnace black having a particle size ranging from 15–100 millimicrons, 10–50% polymer which is soluble in a liquid hydrocarbon, and 40–70% liquid hydrocarbon having a K.B. number between 25 and 35, an electrical resistivity of at least $10^9$ ohm-cm and a dielectric constant of less than 3.5;

B. mildly milling said ingredients for a period of 24–36 hours;

C. storing the milled ingredients to allow such ingredients to settle thereby forming a sediment;

D. seperating the sediment which has settled during the storage; and

E. mixing one to ten parts of the sediment from the milled ingredients with 90 to 99 parts of a liquid hydrocarbon.

14. The method of claim 13 including adding a charge director to the liquid hydrocarbon and sediment mixture.

15. The method of claim 13 wherein said milling of the ingredients is ball milling.

16. The method of claim 13 wherein said milling of the ingredients is pebble milling.

* * * * *